United States Patent [19]

Austin

[11] 3,987,802

[45] Oct. 26, 1976

[54] CHITIN AS AN EXTENDER AND FILTER FOR TOBACCO

[75] Inventor: Paul Rolland Austin, Wilmington, Del.

[73] Assignee: The University of Delaware, Newark, Del.

[22] Filed: Mar. 5, 1975

[21] Appl. No.: 555,546

[52] U.S. Cl. ..... 131/17 R; 131/2

[51] Int. Cl.[2] ..... A24B 15/00; A24B 15/02

[58] Field of Search ..... 131/2, 17 R, 140 C, 131/140 P, 10 R

[56] References Cited

UNITED STATES PATENTS 3,421,519 1/1969 Moshy ..... 131/17

FOREIGN PATENTS OR APPLICATIONS 628,238 9/1961 Canada ..... 131/10 R

*Primary Examiner*—Robert W. Michell
*Assistant Examiner*—Vincent Millin

[57] ABSTRACT

Chitin, either as such or in toasted form, has been found to be an effective extender and filter for tobacco. It can be used in substantial amounts with tobacco blends without adversely affecting such physical properties as packing ability, burning rate or retention of ash. Organoleptic properties such as aroma, taste and smoothness are little affected. To the degree that chitin is used in the mixture, nicotine and noxious tars are reduced. Mixtures of chitin and tobacco represent new compositions.

7 Claims, No Drawings

CHITIN AS AN EXTENDER AND FILTER FOR TOBACCO

The Government of the United States has rights in this invention pursuant to Grant No. 04-3-158-30 with the Department of Commerce.

This invention relates to extenders and filters for tobacco, e.g. cigarette, cigar and pipe tobacco. Tobacco substitutes, diluents and extenders have long been sought for reasons of economy, smoking characteristics or health, but no wholly satisfactory agent has been developed. Difficulties encountered have included such factors as mixing problems, rate and continuity burning, temperature of the smoke, retention of the ash, as well as the more subtle problems of aroma, flavor and irritation of the mouth and throat. Cellulose and modified celluloses, although closely allied to portions of tobacco itself, have found little commercial application.

It is an object of this invention to provide tobacco mixtures that produce lower nicotine and tar on burning while maintaining desirable smoking characteristics.

A further object is to provide an extender for tobacco that can be blended with it satisfactorily to give a mixture with good packing characteristics, burning rate, and holding of fire and ash while retaining such organoleptic properties as aroma, taste and smoothness.

Still another object is to provide the tobacco industry, particularly that segment involved in cigarette, cigar and smoking (pipe) tobacco manufacture, which utilizes extensive blending of many types of tobacco to attain a balance of properties desired for a particular brand, with a superior extender that can be employed in such blends with advantages of economy and reduced hazard to health without impairing materially either their physical or organoleptic properties.

An additional object of the invention is to provide novel compositions to accomplish the foregoing objectives.

It has been found that chitin in admixture with a variety of tobacco blends yields surprisingly smooth smoking compositions with good burning characteristics. In the preferred ranges the blends are quite satisfactory, sometimes preferred and are frequently almost indistinguishable from the parent tobacco. Furthermore, such blends are useful as filters for the tobacco smoke, either in a separate compartment or as the unburned portion of a cigarette.

Chitin is an aminocellulose derivative that occurs widely in nature, for example, in the cell walls of fungi, and the shell of insects and crustaceans. The waste from shrimp, lobster and crab seafood industries contains 10-13 per cent chitin. The innocuous nature of chitin is indicated by the use of ground seafood wastes, such as crab meal, as animal feed and the human consumption of soft-shell crabs as a seafood delicacy.

More specifically, chitin is a mucopolysaccharide, believed to be poly-N-acetyl-D-glucosamine, with an empirical formula of $(C_8H_{13}O_5N)_n$ in which $n$ may be any number into the thousand range, but is commonly in the area of 100–1000. Chitin is prepared, for example, by the hydrolysis of crab-meal alternately with mild acid and alkali to remove calcareous and protein constituents. The substantially complete removal of protein is important to avoid deleterious odors on burning. A typical chitin sample would show upon analysis a moisture content of 5–10%, ash below 1%, and nitrogen in the range of 6.0–7.5%. The use of the term "chitin" herein and in the claims refers to those compounds which are insoluble in dilute acetic acid as distinguished from chitosan that is soluble in dilute acetic acid.

Attention is called to U.S. Pat. No. 3,421,519, patented Jan. 14, 1969, which covers a reconstituted tobacco sheet using a minor proportion of deacetylated chitin as a binder. Deacetylated chitin, usually called chitosan, is prepared by hydrolysis of chitin with strong alkali at the boil for a few hours and subsequent neutralization, filtration, washing and drying. Chitosan is characterized by its solubility in dilute acetic acid, whereas chitin is insoluble. In the patent cited the words "chitin" and "chitosan" are sometimes used interchangably, but it is clear from the disclosure and claims that only the deacetylated chitin, that is, chitosan soluble in dilute acetic acid, is contemplated. There is no example and no teaching of a method for employing the parent chitin as a binder.

Typically crustacean chitin is obtained as a mixture of flaky and short fibrous material, which aids its blending properties and promotes the clinging of coal and ash to a burning cigarette, for example. Considering that chitin is predominately a cellulose derivative, however, it was unexpected that chitin upon burning in tobacco blends would afford a smoke acceptable in aroma, taste and smoothness as well as physical properties.

Toasting of chitin may be advantageous for some blends and may be carried out by exposing it for a few minutes a distance of several inches from a heating unit heated just below a dull red. The time-temperature-distance exposure from the heater is chosen by trial and as a matter of convenience. The toasted products are light brown and have a faint, pleasant odor, but do not caramelize or become sticky. The products blend well with tobacco and in such blends make a satisfactory cigarette.

More effective filters for cigarette and other tobaccos are also needed as requirements for reduction in tar, nicotine and other volatiles in tobacco smoke become more stringent. The chitin modified tobaccos are themselves good filters for the smoke; the unburned mixture acts as a filter, or a cigarette containing the mixture may be used in a pipe or cigarette holder designed to hold such a filter. The chitin mixtures have special aptitude for absorbing phenolic, acidic and other organic compounds of types found in tobacco smoke and hence make effective filter compositions alone, or as filter tips or other filter elements.

In the practice of the invention it is usually advantageous to carry out the blending of the chitin in the normal tobacco blending state, which may then be followed by "casing" or impregnation of the mixture with the customary invert or other sugars, licorice, chocolate, or other flavors and spices, and glycerol or other humectants. If additional color is needed to stain the chitinous fraction, the coloring matter may be added at this stage.

It is recognized that chitin is not in itself a tobacco substitute; it finds its place in blends with tobacco. Hence the tobacco blend used will normally be adjusted to compensate and give a final mixture of the desired quality. Thus chitin contains no nicotine or pectin and is very low in reducing sugars, alcohol-soluble resins and ash, while having a high content of crude fiber, as compared with most tobaccos. The chitin therefore provides considerable latitude for blending to the desired composition of a smoking mixture.

In the practice of the invention, compositions may be utilized ranging from 5 parts of chitin and 95 parts of tobacco to those comprising 75 parts of chitin to 25 parts of tobacco. However, the most suitable ranges of compositions are those containing 10–35 percent of chitin, since they give the best balance of physical and organoleptic properties. Examples of several of the useful compositions follow.

EXAMPLE I

A commercial flaky, fairly strong smoking tobacco of bulk density about 0.2 g. per cc. was intimately mixed in several proportions by volume with chitin having both flake and fibrous particles, and a bulk density also of about 0.2 g. per cc. The mixtures were rolled into cigarettes and smoked. As the proportion of chitin increased, the physical properties of the cigarettes decreased somewhat, but sensory factors of taste, mildness and coolness were maintained well. Bite was relatively the same in the group, although throat irritation increased somewhat with increasing chitin content. The tests are tabulated below:

| Tobacco, parts | Chitin, parts | Smoking Characteristics |
|---|---|---|
| 100 | 0 | Taste satisfactory, mild, trace of bite, some throat irritation, cool |
| 95 | 5 | About same as above, some throat irritation, slightly more smoke, but cool |
| 90 | 10 | Mild, cool, taste satisfactory, trace of bite, somewhat more throat irritation |
| 75 | 25 | Smoke well, self-propagating, milder than tobacco alone, slight bitter note |
| 50 | 50 | Draws easily, self-propagating, milder than tobacco alone, bitter note |
| 25 | 75 | Poor draw, marginal fire-holding capacity, mild taste |

EXAMPLE II

A medium strong blended Turkish and domestic cigarette tobacco, aromatic and shredded type with a bulk density of about 0.3 g. per cc. was intimately mixed with a flake and fibrous chitin, the chitin being at the 10 percent and 20 percent by volume levels for comparison with the whole tobacco. The modified products smoked well, had an aromatic odor, fairly strong flavor, taste about the same as the unmodified tobacco. The smoke was cool in the modified products as well as with the straight tobacco. All had a trace of bite. At the 20 percent chitin level the smoke when inhaled irritated the throat somewhat more than that from the 10 percent chitin mixture.

EXAMPLE III

A 50:50 mixture by volume of a mild shredded cigarette tobacco and toasted chitin was intimately blended and made into a menthol-tip filter cigarette. Upon smoking there was abundant smoke. The odor was good and the taste was neutral except for a faint menthol flavor from the filter. There was little after-taste.

When inhaled, the smoke was somewhat irritating, but not bitter.

EXAMPLE IV

A series of blends of toasted chitin with a light cigarette tobacco was prepared containing 5, 10, 20, 35, and 50 percent by weight of the toasted chitin. They were made into filter cigarettes and test smoked by several persons in comparison with a 100 percent tobacco control. The data were scattered with considerable variation among evaluators because of sex, nonsmokers, cigarette, pipe or cigar smokers, order and interval of testing, etc. However, the following conclusions and indications emerged:

1. There was uniform agreement that the extended tobacco mixture cigarettes were cool, slowburning and held ash well over the 5–50 percent toasted chitin range.

2. The aroma of the smoke was a minor consideration; none of the mixtures was objectionable, although some thought the smoke slightly pungent, as they did the straight tobacco.

3. Surprisingly, there was little change in mildness with increasing content of toasted chitin; i.e., some smokers considered the mixtures mild, but nevertheless a trace of bite was noted by several evaluators and half of the group considered the control tobacco to have a bite.

4. In preference of the control tobacco versus the mixtures, opinion was about evenly divided and half of the smokers did not distinguish between them; thus 75 percent of the group either preferred the toasted chitin modification or had no preference. Again, increasing concentrations of the toasted chitin did not appear to have much effect on choice.

EXAMPLE V

Chitin was impregnated with an aqueous solution of glucose over night, the excess solution removed and the product dried. Twenty percent by volume of the material was blended with a filter blend cigarette tobacco and made into the filter-tip cigarettes. Both the modified and 100% tobacco cigarettes were cool, slow burning and held ash well. The smoke was somewhat aromatic, and had a slight bite and after taste as did the tobacco control. The tobacco control was judged slightly milder, but there was no preference between the two.

EXAMPLE VI

A chitin sample, bleached with 3 percent hydrogen peroxide solution, was blended at the 20 percent by volume level with a very aromatic, Virginia, fully ripe smoking tobacco and the mixture smoked in a pipe. There was no noticable difference in the taste or burning as compared with the control tobacco.

EXAMPLE VII

Chitin at the 20 and 33 percent by volume level was blended with a light, shredded cigarette tobacco having a bulk density of about 0.2 g. per cc., and the mixture made into filter tip cigarettes. Comparisons were made versus each other and versus a 100 percent tobacco control. At both levels the modified cigarettes are cool, have good fire-holding capacity and hold ash well. At the 20 percent chitin level aroma was pleasant to slightly pungent, with a trace of bite and after taste, but comparable to the tobacco control and with no preference between them. At the 33 percent chitin level the cigarette seemed slightly stronger, but there was no preference between the 20 and 33 percent chitin cigarettes.

EXAMPLE VIII

A cigarette made wholly of chitin is placed in a cigarette holder containing a filter chamber accommodating a cigarette-sized filter; upon smoking a commercial cigarette in this holder, the smoke is cooler, milder and less irritating. Similarly, a chitin cigarette inserted in the filter chamber of a smoking pipe cools and decreases the bite of the smoking tobacco; it also handles the condensed moisture well.

While particular examples of the present invention have been shown and described, it is apparent that changes and modification may be made herein without departing from the invention in its broadest aspects. The aim of the appended claims, therefore, is to cover all such changes and modifications as fall within the true spirit and scope of the invention.

I claim:

1. A tobacco mixture containing chitin, which is insoluble in dilute acetic acid, as an extender.

2. The tobacco mixture of claim 1 wherein the chitin is present in an amount of at least 5% of the tobacco.

3. The tobacco mixture of claim 1 wherein the chitin is present in an amount of 5 to 75% of the tobacco mixture.

4. The tobacco mixture of claim 1 wherein the chitin is toasted chitin.

5. In a cigarette having a main body portion and a tip filter portion distinct from the main body portion, the improvement which comprises incorporating in the filtering medium of the tip filter portion at least 5% chitin which is insoluble in dilute acetic acid.

6. The cigarette of claim 5 wherein the filtering medium consists of a mixture of tobacco and said chitin which is insoluble in dilute acetic acid.

7. The cigarette of claim 5 wherein the filtering medium consists essentially of said chitin which is insoluble in dilute acetic acid.

* * * * *